US006988388B2

(12) United States Patent
Allart et al.

(10) Patent No.: US 6,988,388 B2
(45) Date of Patent: Jan. 24, 2006

(54) THREAD ROLLING ATTACHMENT

(75) Inventors: Paul W. Allart, Rochester, NY (US); Sandro G. Belpanno, Rochester, NY (US)

(73) Assignee: C.J. Winter Machine Technologies, Inc., Rochester, NY (US)

( * ) Notice: Subject to any disclaimer, the term of this patent is extended or adjusted under 35 U.S.C. 154(b) by 79 days.

(21) Appl. No.: 10/806,505

(22) Filed: Mar. 23, 2004

(65) Prior Publication Data

US 2005/0210943 A1 Sep. 29, 2005

(51) Int. Cl.
*B21H 3/04* (2006.01)

(52) U.S. Cl. ..... 72/104; 72/108; 72/121

(58) Field of Classification Search ..... 72/102, 72/103, 104, 108, 120, 121; 470/66, 70, 470/82, 83

See application file for complete search history.

(56) References Cited

U.S. PATENT DOCUMENTS 2,704,950 A * 3/1955 Scott ..... 72/104
4,096,722 A * 6/1978 Torralba ..... 72/104
5,568,743 A * 10/1996 Oppelt ..... 72/121
6,684,674 B2 * 2/2004 Focken ..... 72/121

* cited by examiner

*Primary Examiner*—Ed Tolan
(74) *Attorney, Agent, or Firm*—Phillips Lytle LLP

(57) ABSTRACT

A thread rolling attachment (50) is adapted to be mounted on a machine tool and to be selectively moved in an axially direction relative to a workpiece (W) having a cylindrical surface upon which a thread is to be rolled. The improvement broadly includes a center plate (62) having three circularly-spaced detents (82); a front plate (66) having a central portion (70) arranged in axially-spaced relation to the center plate and having three circularly-spaced lugs (71) extending toward the center plate such that their distal end faces are adapted to engage and bear against a center plate surface (81); a recess (73) extending into each lug from such distal surface, each recess adapted to receive a respective one of the detents for angularly orienting the center and front plates relative to one another; three eccentric roll pins (63) having their opposite marginal end portions journalled on the center and front plates, and spaced equally from one another about an imaginary circle; a thread roll (65) rotatably mounted on each eccentric roll pin; and a plurality of fasteners (68) operatively arranged to selectively hold the center and front plates together; whereby, when the thread rolling attachment is assembled, the front plate will have improved rigidity and will be less susceptible to deformation.

4 Claims, 5 Drawing Sheets

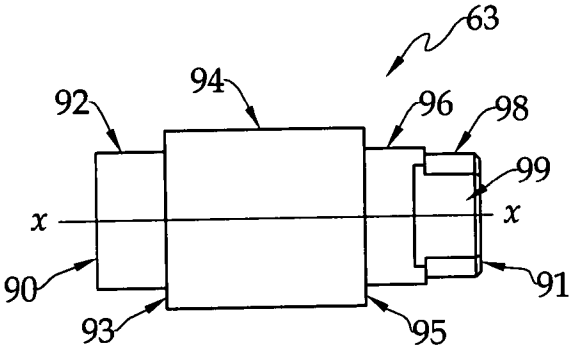
Fig. 12
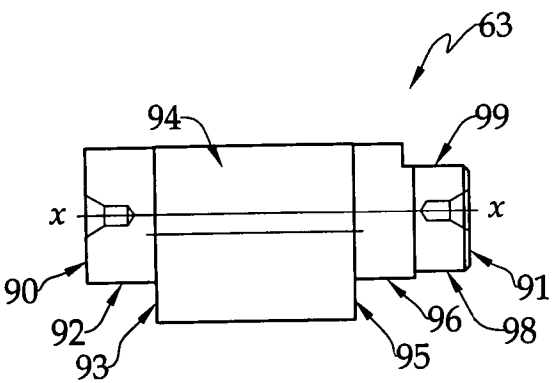
Fig. 11
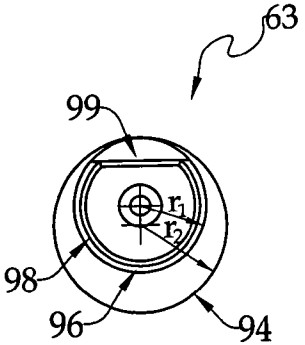
Fig. 13
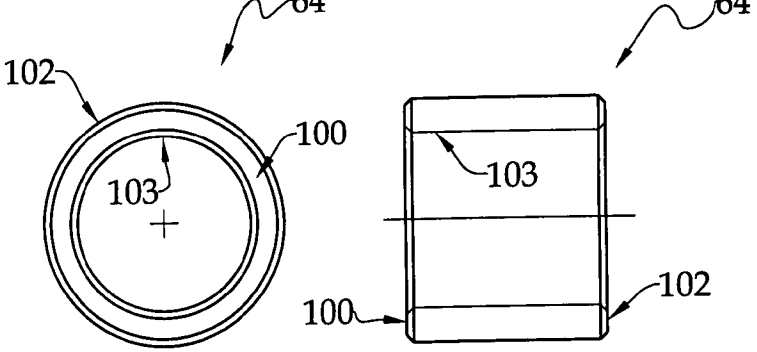
Fig. 15
Fig. 14

THREAD ROLLING ATTACHMENT

TECHNICAL FIELD

The present invention relates generally to the field of thread rolling attachments for machine tools, and more particularly, to an improved thread rolling attachment that is adapted to be mounted on a machine tool and to be selectively moved in an axial direction relative to a workpiece having a cylindrical surface on which a thread is to be rolled.

BACKGROUND ART

It is often desired to roll a thread onto a workpiece. There are a number of ways of doing this. In some cases, thread rolls are moved tangentially into engagement with the cylindrical surface of a workpiece onto which a thread is to be rolled. In other instances, the thread rolls are moved axially into position along side the workpiece, and are then moved radially inwardly to engage the workpiece and to roll the thread thereon.

According to still another technique, an attachment is provided on a machine tool. The attachment has three thread rolls that are movable radially between engaged and disengaged positions. Initially, the three thread rolls are moved radially inwardly to an engaged position. The workpiece is then feed axially into the space between the three rolls, either through movement of the workpiece relative to the attachment or vice versa, and a thread is progressively rolled onto the workpiece. When the end of the workpiece abuts a stop, a triggering mechanism causes the spring-biased thread rolls to quickly move radially outwardly so as to disengage themselves from the workpiece and to allow the workpiece to be withdrawn from the attachment.

One such type of end working attachment is shown and described in U.S. Pat. No. 5,568,743, which issued on Oct. 29, 1996 to Wilhelm Fette GmbH. This patent discloses in FIG. 1, a conventional prior art end working attachment of the type heretofore described.

Other types of thread rolling attachments and implements are shown and described in U.S. Pats. No. 2,909,087, 3,352,139, 3,365,924 and 4,771,625. The disclosure of all five of the above patents is hereby incorporated by reference insofar as their descriptions of the structure and operation of prior art thread rolling attachments is concerned.

Upon information and belief, one problem that accompanies the use of the device shown in FIG. 1 of the Fette '743 patent, is that the front plate is relatively thin and flexible, and may distort in use. This can adversely affect the shape and profile of the threads that are rolled onto a workpiece.

Accordingly, it would be generally desirable to provide an improved thread rolling attachment of the same general type, that would have increased rigidity, and would be less susceptible to distortion.

DISCLOSURE OF THE INVENTION

With parenthetical reference to the corresponding parts, portions or surfaces of the disclosed embodiment, merely for purposes of illustration and not by way of limitation, the present invention broadly provides an improved thread rolling attachment (50) that is adapted to be mounted on a machine tool and to be selectively moved in an axially direction relative to a workpiece.

The workpiece has a cylindrical surface on which a thread is to be rolled. The attachment has a spring housing (56), a sun gear (60) rotatably mounted on the spring housing, and three planetary gears (61, 61, 61) matingly engaging the sun gear at equidistant locations thereabout. A torsional spring (59) acts between the spring housing and the sun gear.

In this form, the improvement broadly comprises: a center plate (62) having three circularly-spaced detents (82, 82, 82); a front plate (66) having a central portion (70) arranged in axially-spaced relation to the center plate and having three circularly-spaced lugs or projections (71) extending toward the center plate such that the distal end surfaces of such lugs or projections are adapted to engage the center plate when the device is assembled; a recess (73) extending into each lug from such distal surface, each recess being adapted to receive a respective one of the detents for angularly orienting the center and front plates relative to one another; three eccentric roll pins (63, 63, 63) having their opposite marginal end portions journalled on the center and front plates and being spaced equally from one another about an imaginary circle; a thread roll (65) rotatably mounted on each eccentric roll pin; and a plurality of fasteners (68) operatively arranged to selectively hold the center and front plates together; whereby, when the thread rolling attachment is assembled, the front plate will have improved rigidity and will be less susceptible to deformation in use.

The center and front plates may be provided with a low friction coating. The axes of the roll pins may be skewed with respect to the longitudinal axis of the workpiece and the cylindrical surface thereon. Moreover, a carbide bushing may be operatively arranged between each thread roll and its associated roll pin.

Accordingly, the general object of the invention is to provide an improved thread rolling attachment.

Another object is to provide an improved end working attachment that is adapted for use in a machine tool, for rolling a thread onto a workpiece.

Still another object is to provide an improved end-working thread-rolling attachment which is more durable, more rigid, and less susceptible to deformation in use.

These and other objects and advantages will become apparent from the foregoing and ongoing written specification, the drawings, and the appended claims.

BRIEF DESCRIPTION OF THE DRAWINGS

FIG. 11 is a side elevational view of one of the eccentric roll pins.

FIG. 12 is a top plan view of the eccentric roll pin shown in FIG. 11.

FIG. 13 is a right end elevation of the eccentric roll pin shown in FIG. 11.

FIG. 14 is a side elevational view of one of the carbide roll bushings.

FIG. 15 is a left end elevation of the bushings shown in FIG. 14.

DESCRIPTION OF THE PREFERRED EMBODIMENTS

Figure 1:
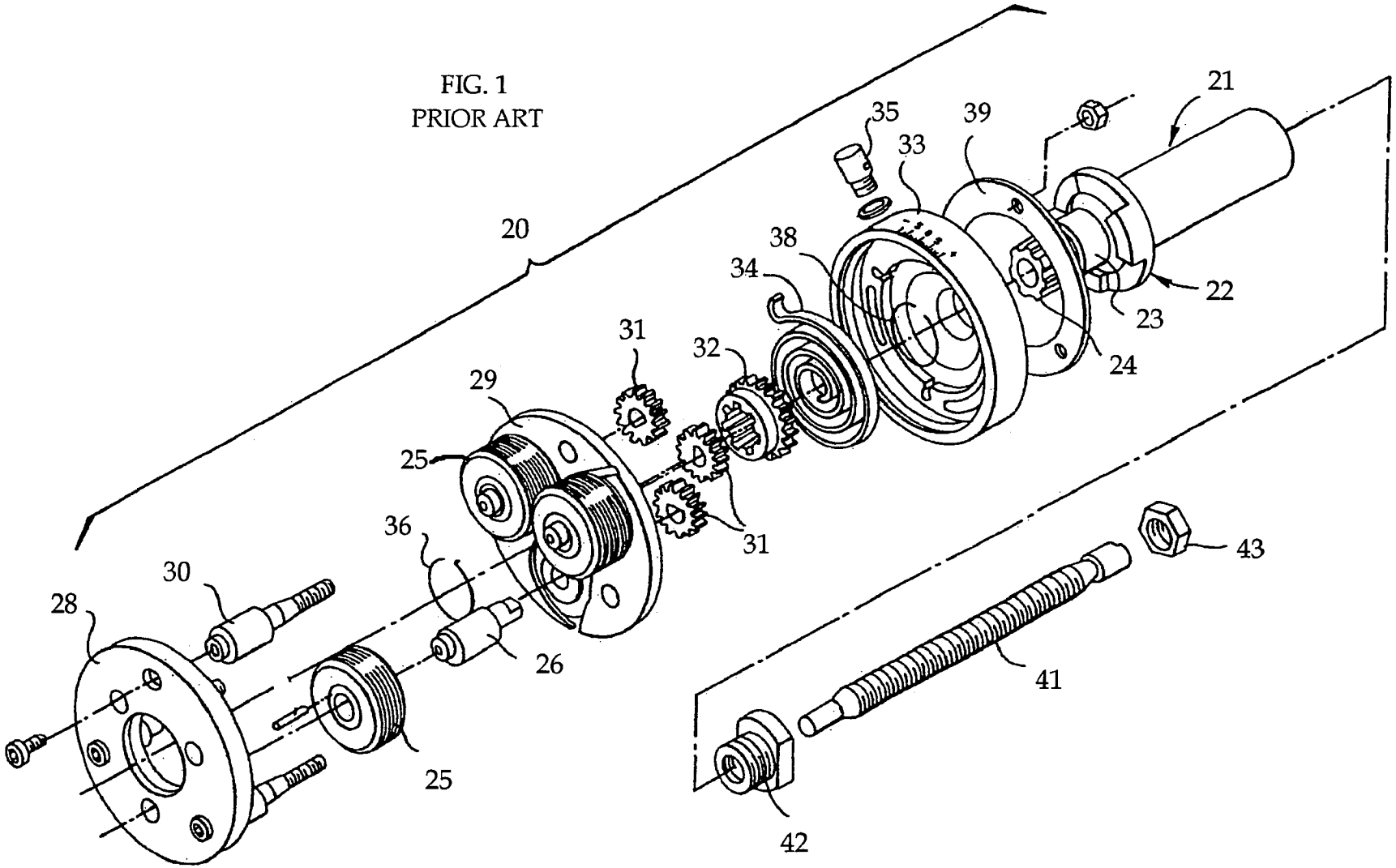
FIG. 1 PRIOR ART
FIG. 1 is an isometric exploded view of a prior art thread rolling attachment, this view being substantially the same as that shown in U.S. Pat. No. 5,568,743.

At the outset, it should be clearly understood that like reference numerals are intended to identify the same structural elements, portions or surfaces consistently throughout the several drawing figures, as such elements, portions or surfaces may be further described or explained by the entire written specification, of which this detailed description is an integral part. Unless otherwise indicated, the drawings are intended to be read (e.g., cross-hatching, arrangement of parts, proportion, degree, etc.) together with the specification, and are to be considered a portion of the entire written description of this invention. As used in the following description, the terms "horizontal", "vertical", "left", "right", "up" and "down", as well as adjectival and adverbial derivatives thereof (e.g., "horizontally", "rightwardly", "upwardly", etc.), simply refer to the orientation of the illustrated structure as the particular drawing figure normally faces the reader. Similarly, the terms "inwardly" and "outwardly" generally refer to the orientation of a surface relative to its axis of elongation, or axis of rotation, as appropriate.

Prior Art Attachment (FIG. 1)

Referring now to the drawings, and more particularly, to FIG. 1 thereof, a conventional axial thread rolling head, such as shown in FIG. 1 of U.S. Pat. No. 5,568,743, is depicted as including a bearing unit 20 and a shank 21. Shank 21 is adapted to be clamped into the spindle of a numerically-controlled machine tool (not shown). The shank broadly includes a coupling portion 22, a cylindrical bearing portion 23, and a spline connection portion 24.

The bearing unit includes three profile rollers, severally indicated at 25. Each roller is supported on an eccentric shaft, one of which is indicated at 26. The marginal end portions of eccentric shafts 26 are received in corresponding bores provided in a front plate 28 and a center plate 29, respectively. Front and center plates 28, 29 are spaced from one another by three specially-configured bolts, severally indicated at 30. The threaded shank portion of each bolt 30 extends through a corresponding bore provided in center plate 29. The thread rollers 25 are rotatably supported on the eccentric shafts 26, which, at their rear ends, are shown as being flattened. These flattened ends cooperate with complementarily-configured holes in planetary gear wheels 31 meshing with a central sun gear 32. The central sun gear is mounted on the spline connection portion 24 of shaft 21. Rotation of the central sun gear 32 causes the three planetary gears 31, 31, 31, and the three eccentric shafts 26, 26, 26 mounted thereon, to rotate. Rotation of the eccentric shafts 26 relative to the front and central plates results in a change of the radial distance of the outer surfaces of the profile rollers relative to the workpiece axis. The thread milling makes a preset distance between the profile rollers necessary. This radial distance must be selectively increased for removing the workpiece, indicated at W, from between the rollers.

A spring housing 33 provided with a central bore is arranged on a bearing portion 23, and includes a claw clutch portion (not shown) which cooperates with the claw clutch portion 22 of shank 21. A torsional spring 34 is arranged in the spring housing 33. The outer end of spring 34 cooperates with a slot (not shown) within spring housing 33. The inner end of the helical spring is connected to a portion (not shown) of shank 21. A shank 35 is provided on the outer periphery of the spring housing. Shank 25 may be grasped and twisted with the spring housing if the claw clutch portions are out of mesh. Spring rings 36, 38 ensure the axial support of the bearing unit 20 on shank 21. The threaded shank portions of bolts 30 extend through holes provided on the spring housing and bores through a disk 39. The spring housing 53 is attached to central plate 29 by means of nuts 40.

A bolt 41 is secured in shank 21 with the aid of two nuts 42, 43. The axial position of bolt 41 within shank 21 is adjustable by virtue of its threaded connection within shank 21.

The function of the prior art rolling head is as follows. The rollers 25 are initially spaced apart from one another at a preset radial distance while the claw clutch portions are in meshing engagement with each other. In this position, the torsional spring is wound. To mill a thread into a workpiece, the workpiece is guided axially between the radially-inwardly positioned rollers 25, either by movement of the machine tool spindle relative to the workpiece or vice versa. The workpiece moves into the rolling head until its end face abuts the end face of bolt 41. In this way, the feed of shank 21 is terminated together with the bearing unit 20 and the bearing unit 20 itself continues moving as a result of the described feed. This causes the claws of the claw clutch to get out of mesh and the spring housing 33, and, consequently, the bearing unit 20 rotates in response to the action of spring 34, this rotation being performed over preset angle of rotation as a result of the out-of-mesh portion of the claw clutch. This relative rotation of shank 21 and the bearing unit 20 causes the eccentric pins 26 to be rotated so that the profile rollers move radially outwardly to disengage from the workpiece. The workpiece can then be removed from the rolling head.

To lock the rolling head again, spring housing 33 must be rotated in the opposite direction by grasping of shaft 35 and rotating the spring housing until the claw clutch can again lock into place.

Improved Thread Rolling Attachment (FIGS. 2–13)

Figure 2:
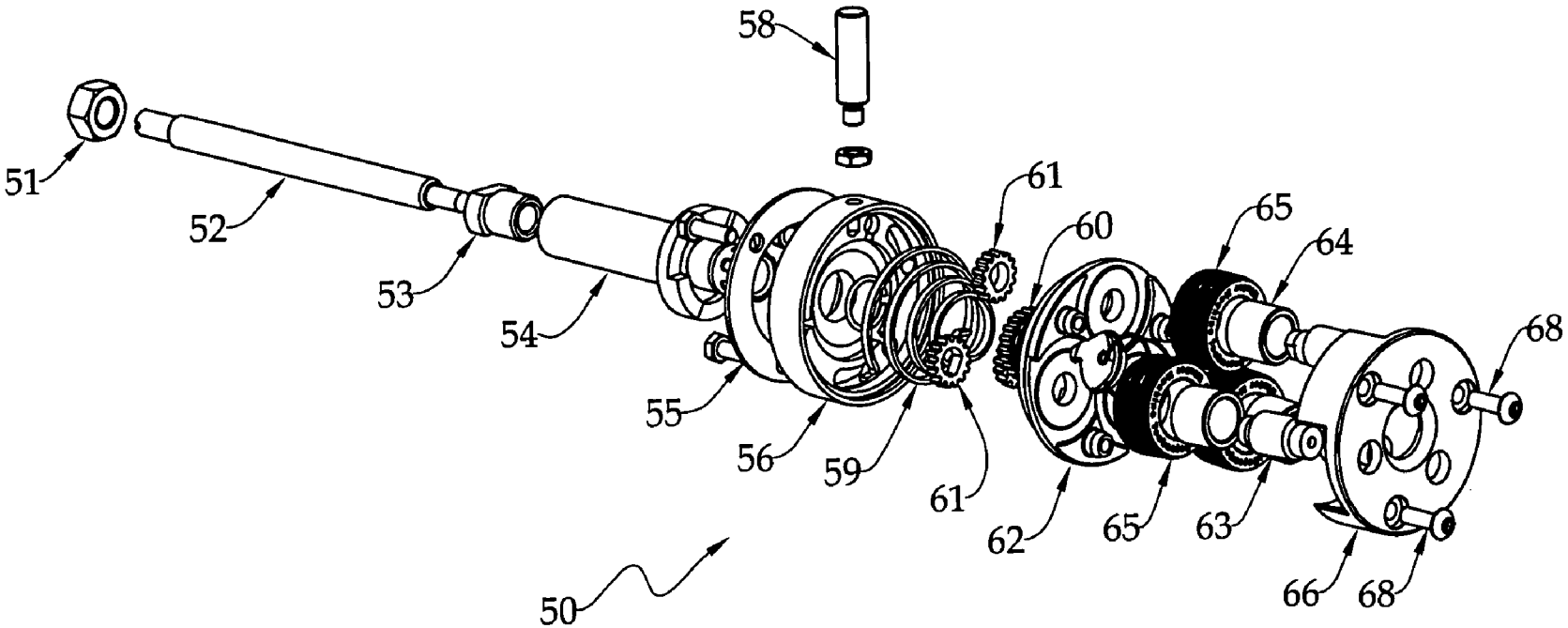
FIG. 2 is an isometric exploded view of an improved thread rolling attachment incorporating the present invention.
Figure 6:
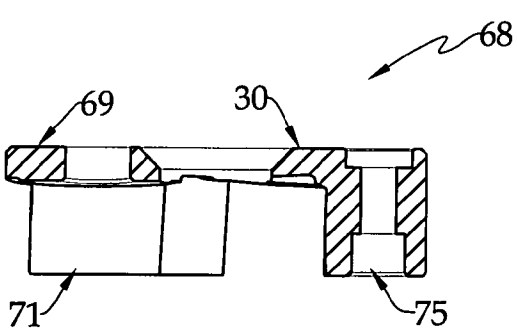
FIG. 6 is a fragmentary horizontal sectional view of the front plate, taken generally on line 6—6 of FIG. 4.
Figure 4:
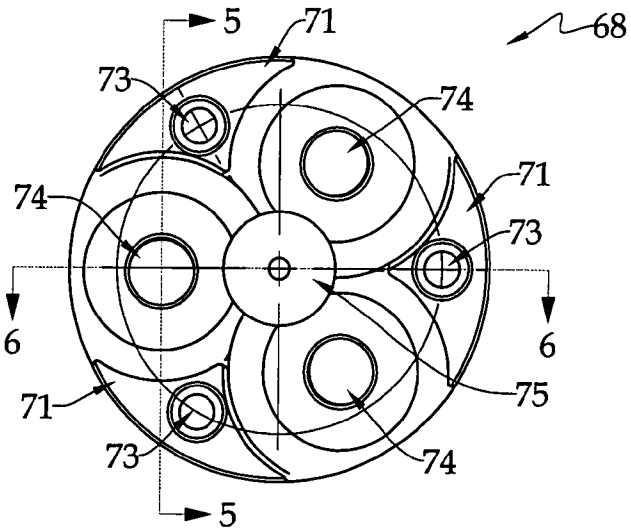
FIG. 4 is a rear elevation of the front plate shown in FIG. 3.
Figure 3:
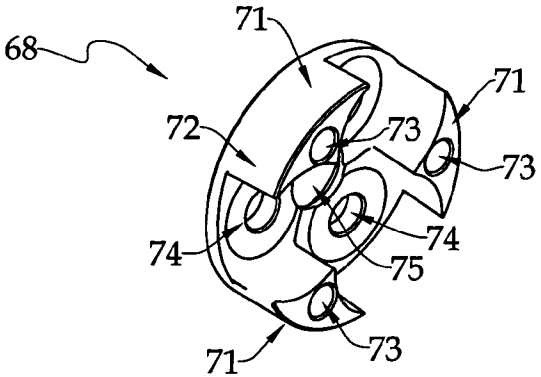
FIG. 3 is an isometric rear view of the front plate shown in FIG. 2.

Referring now to FIG. 2, an improved thread rolling attachment is generally indicated at 50. This attachment is shown as broadly including, from left to right in FIG. 2: a nut 51; a threaded shaft 52; a stop screw body 53; a shank 54; a washer 55; a spring housing 56 having a stud 58 thereon; a torsional spring 59; a sun gear 60; three planetary gears, severally indicated at 61; a central plate 62; three eccentric pins, severally indicated at 63; three carbide bushings, severally indicated at 64; three thread rolls, severally indicated at 65; a front plate 66; and a plurality of fasteners, severally indicated at 68, that are arranged to selectively and releasably hold the front plate to the center plate.

The structure to the left (i.e., to the rear) of the center plate is individually old.

The inventive portion relates to the center plate 62, the front plate 66, and the structure therebetween.

Figure 5:
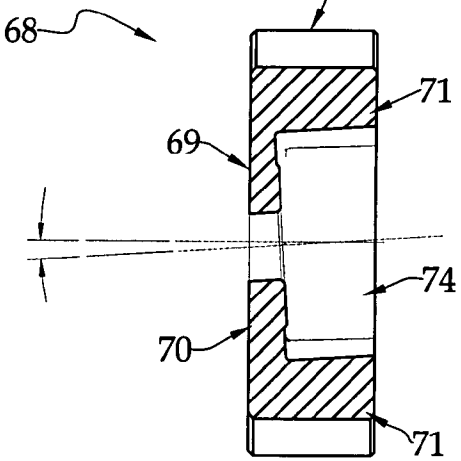
FIG. 5 is a fragmentary vertical sectional view of the front plate, taken generally on line 5—5 of FIG. 4.
Figure 10:
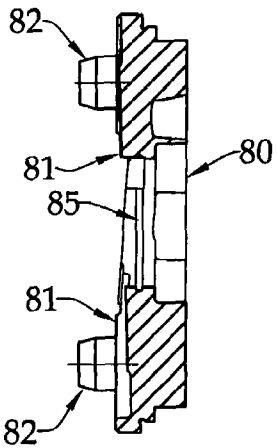
FIG. 10 is a fragmentary vertical sectional view of the center plate, taken generally on line 10—10 of FIG. 8.

Referring now to FIGS. 3–6, the front plate 66 is shown as being a specially-configured member having an annular vertical front end face 69. The front plate has a central portion 70 and three circularly-spaced lugs or projections, severally indicated at 71, extending rearwardly from the outer margins of the central portion 70 toward the center plate. Each of these lugs has a cylindrically-segmented outer surface, severally indicated at 72. A through-hole or recess, indicated at 73, extends forwardly into each lug to accommodate and receive a locating or positioning detent on the central plate 62, as described infra. The front plate has three openings, severally indicated at 74, defined between the adjacent lugs. These openings are skewed at an angle with respect to the front plate longitudinal axis, as shown in FIG. 5, and are adapted to receive the front marginal end portions of eccentric pins 63. A central opening, indicated at 75, is provided to accommodate passage of the workpiece.

Figure 8:
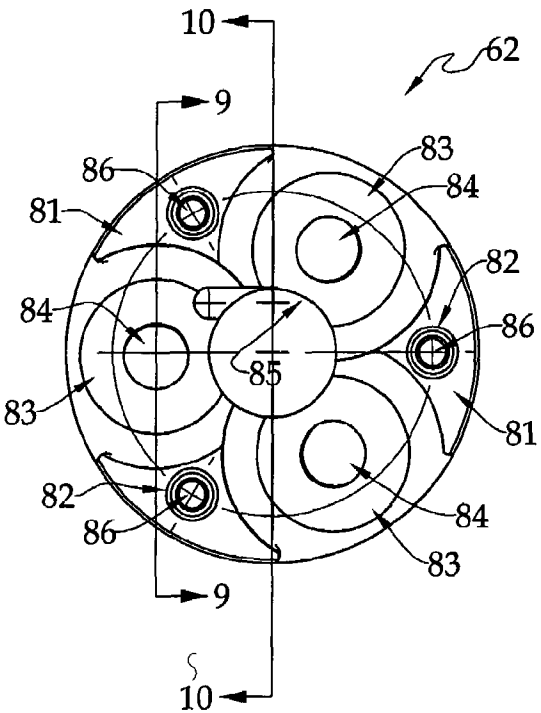
FIG. 8 is a front elevation of the center plate shown in FIG. 7.
Figure 7:
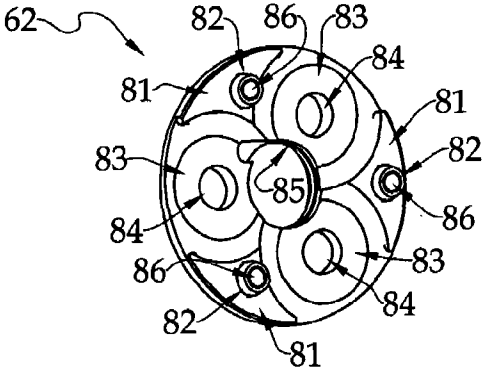
FIG. 7 is an isometric front view of the center plate shown in FIG. 2.
Figure 9:
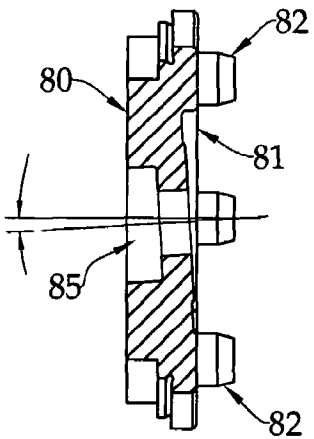
FIG. 9 is a fragmentary vertical sectional view of the center plate, taken generally on line 9—9 of FIG. 8.

Referring now to FIGS. 7–10, the central plate 62 is also shown as being a specially-configured member having an annular vertical rear surface 80, and a specially-configured front surface 81 arranged in spaced facing relation to the front plate. Three detents, severally indicated at 82, extend forwardly from surface 81, and are adapted to be received in front plate holes or recesses 73. As best shown in FIGS. 7 and 8, three circularly-spaced recesses, severally indicated at 83, each arranged at an angled skewed to the longitudinal axis of the assembly, are provided in the central plate. Each recess surrounds a hole 84, which is adapted to accommodate and receive the rear marginal end portion of a respective one of the eccentric pins 63. A central hole 85 extends through the central plate. The cocked recesses 83 give the impression that each surface 81 has three surfaces having the same general profile as the lugs on the front plate. In fact, the distal ends of the front plate lugs are adapted to bear against such complementarily-configured surfaces 81. The detents 82 are provided with tapped through-holes, indicated at 86.

Referring now to FIGS. 11–13, each eccentric pin 63 is shown as being a horizontally-elongated specially-configured member having a longitudinal axis x—x. The eccentric pins have an annular vertical left end face 90, an annular vertical right end face 91, an outer surface that sequentially includes a cylindrical portion 92 extending rightwardly from the outer marginal of left end face 89, a leftwardly-facing annular vertical surface 93, a cylindrical surface 94 generated about an axis other than axis x—x so as to form a cam surface, a rightwardly-facing annular vertical surface 95, a horizontal cylindrical surface 96, and a reduced-diameter cylindrical surface 98 continuing rightwardly therefrom to join the right end face 91. Surface 98 has a flat 99 milled thereon. A pair of tapped blind holes are provided in the eccentric pin from either end face.

Referring now to FIGS. 14 and 15, bushing 64 is shown as being a specially-configured hollow tubular cylindrical member having an annular vertical left end face 100, an annular vertical right end face 101, an outer cylindrical surface 102, and an inner cylindrical surface 103. Bushing 64 is adapted to be slipped over the central surface 94 of an eccentric pin.

The device is assembled as shown in FIG. 2. The rear marginal end portions of the eccentric pins 63 are received in the holes 84 provided in the central plate. The carbide bushings 64 surround the central portions of the eccentric pins, and the thread-forming rolls 65 are slipped thereover. The front marginal end portions of the eccentric pins are received in front plate holes 74. The front plate is mounted on the rear plate such that the rear plate detents 82 are received in the front plate recesses 73. This functions to angularly orient the front plate relative to the rear plate. The distal ends of the front plate lug surfaces bear against center plate surfaces 81. Thereafter, conventional screw-type fasteners 68 may be passed through the front plate openings 73 such that their threaded shank portions will be matingly received in center plate recess tapped openings 83.

As can be seen, the improved thread rolling attachment has a front plate assembly that is substantially more rigid, and less susceptible to bending and deformation than in the prior art. Moreover, the front end center plates may be coated with suitable low friction coating. The carbide bushings afford long life to the assembly. In addition to this, the assembly may be assembled by means of standard fasteners 68, rather then specially-machined spacers as in the prior art. Thus, the improved device offers the advantage of a reduced cost, as compared to the prior art. It may use the same thread rolls as in the prior art machine shown in FIG. 1. It is compact in size, and easily adjustable.

Modifications

The present invention expressly contemplates that many changes and modifications may be made. For example, the structure to the rear of the center plate may be readily changed or modified as desired. The shape and configuration of the various parts and components, specifically including the center plate, the front plate and the structure therebetween, may be changed or modified as desired. The materials of construction are not deemed to be particularly critical.

Therefore, while the presently preferred embodiment of the improved thread roll attachment has been shown and described, and some modifications and changes thereof discussed, persons skilled in this art will readily appreciate that various additional changes and modifications may be made without departing from the spirit of the invention, as defined and differentiated by the following claims.

What is claimed is:

1. In a thread rolling attachment adapted to be mounted on a machine tool and be selectively moved in an axial direction relative to a workpiece having a cylindrical surface upon which a thread is to be rolled, said attachment having a spring housing, a sun gear rotatably mounted on said spring housing, three planetary gears engaging said sun gear at equidistant locations thereabout, and a helical spring acting between said spring housing and said sun gear, the improvement comprising:

a center plate having three circularly-spaced detents;

a front plate having a central portion arranged in axially-spaced relation to said center plate and having three circularly-spaced lugs extending toward said center plate such that the distal end surfaces of said lugs are adapted to engage said center plate;

a recess extending into each lug from said distal surface, each recess adapted to receive a respective one of said detents for angularly orienting said center and front plates relative to one another;

three eccentric roll pins having their opposite marginal end portions journalled on said center and front plates, and spaced equally from one another about an imaginary circle;

a thread roll rotatably mounted on each eccentric roll pin; and a plurality of fasteners operatively arranged to selectively hold said center and front plates together;

whereby, when said thread rolling attachment is assembled, said front plate will have improved rigidity and will be less susceptible to deformation.

2. The improvement as set forth in claim 1 wherein said center and front plates are provided with a low friction coating.

3. The improvement as set forth in claim 1 wherein the axis of said roll pins is skewed with respect to the axis of said workpiece cylindrical surface.

4. The improvement as set forth in claim 1 and further comprising a carbide bushing operatively arranged between each thread roll and the associated roll pin.

* * * * *